US011204193B2

(12) United States Patent
Aikawa et al.

(10) Patent No.: US 11,204,193 B2
(45) Date of Patent: Dec. 21, 2021

(54) REFRIGERATION APPARATUS

(71) Applicant: SHINWA CONTROLS CO., LTD, Kawasaki (JP)

(72) Inventors: Daisuke Aikawa, Kawasaki (JP); Hirofumi Komori, Kawasaki (JP)

(73) Assignee: Shinwa Controls Co., Ltd, Kawasaki (JP)

( * ) Notice: Subject to any disclaimer, the term of this patent is extended or adjusted under 35 U.S.C. 154(b) by 265 days.

(21) Appl. No.: 16/462,282

(22) PCT Filed: Dec. 1, 2017

(86) PCT No.: PCT/JP2017/043248
§ 371 (c)(1),
(2) Date: May 20, 2019

(87) PCT Pub. No.: WO2018/105511
PCT Pub. Date: Jun. 14, 2018

(65) Prior Publication Data

US 2019/0338993 A1 Nov. 7, 2019

(30) Foreign Application Priority Data

Dec. 6, 2016 (JP) ..... JP2016-236998

(51) Int. Cl.
*F25B 49/02* (2006.01)
*F25B 39/04* (2006.01)
(Continued)

(52) U.S. Cl.
CPC ..... *F25B 49/02* (2013.01); *F25B 39/02* (2013.01); *F25B 39/04* (2013.01); *F28D 9/02* (2013.01)

(58) Field of Classification Search
CPC ..... F25B 2500/22; F25B 2500/221; F25B 2500/222; F25B 2500/25; F25B 2600/05
See application file for complete search history.

(56) References Cited

U.S. PATENT DOCUMENTS

2012/0137725 A1* 6/2012 Kim ..... F28D 9/005 62/509

FOREIGN PATENT DOCUMENTS

JP 2000-274894 A1 10/2000
JP 2000274894 A * 10/2000
(Continued)

OTHER PUBLICATIONS

Korean Office Action (Application No. 10-2019-7016435) dated Jul. 1, 2020 (with English translation).
(Continued)

*Primary Examiner* — Nelson J Nieves
*Assistant Examiner* — Meraj A Shaikh
(74) *Attorney, Agent, or Firm* — Burr & Brown, PLLC

(57) ABSTRACT

Leakage of a heating medium from a condenser or an evaporator can be quickly detected by a simple structure. A refrigeration apparatus 1 according to the present invention is formed by connecting a compressor 11, a condenser 12, an expansion valve 13 and an evaporator 14 by a pipe 15 such that a heating medium circulates therethrough in this order. The refrigeration apparatus 1 further includes a pressure detection unit 31, 32 that detects a pressure of the heating medium flowing through the pipe 15, and a control unit 41 that determines that leakage of the heating medium from the condenser 12 or the evaporator 14 has occurred, when a pressure detected by the pressure detection unit 31, 32 becomes not more than a predetermined value.

3 Claims, 3 Drawing Sheets

(51) Int. Cl.
*F25B 39/02* (2006.01)
*F28D 9/02* (2006.01)

(56) References Cited

FOREIGN PATENT DOCUMENTS

| | | | | | |
|---|---|---|---|---|---|
| JP | 2007-232337 | A1 | | 9/2007 | |
| JP | 2012-215368 | A1 | | 11/2012 | |
| JP | 2012215368 | A | * | 11/2012 | |
| JP | 2014-163593 | A1 | | 9/2014 | |
| WO | WO-2010007448 | A1 | * | 1/2010 | ..... F25B 49/005 |

OTHER PUBLICATIONS

International Search Report and Written Opinion (Application No. PCT/JP2017/043248) dated Feb. 13, 2018.
English translation of International Preliminary Report on Patentability (Application No. PCT/JP2017/043248) dated Jun. 20, 2019.

* cited by examiner

REFRIGERATION APPARATUS

FIELD OF THE INVENTION

The present invention relates to a refrigeration apparatus capable of detecting leakage of heating medium.

BACKGROUND ART

In a refrigeration apparatus, a compressor, a condenser, an expansion valve and an evaporator are connected by a pipe such that a heating medium circulates therethrough in this order. A condenser in such a refrigeration apparatus is roughly classified into an air-cooled one and a liquid-cooled one. An air-cooled condenser, which cools a heating medium by wind from a blower, is mainly employed in an air conditioner for household use. On the other hand, a liquid-cooled condenser, which cools a heating medium by cooling water such as tap water or ground water, is mainly employed in a large equipment such as a plant. In an air-cooled condenser, a blower may stir up dust. Thus, a semiconductor manufacturing equipment or the like generally employs a liquid-cooled condenser because the dust may affect these equipment.

In a refrigeration apparatus, a plate-type heat exchanger is sometimes used as a liquid-cooled condenser. A plate-type heat exchanger of a convection type is known, in which a heating medium flows on one side with respect to a partition wall in a heat exchanger, cooling water flows on the other side with respect to the partition wall, and the heating medium and cooling water flow in opposite directions. A plate-type heat exchanger of a parallel flow type is known, in which a heating medium flows on one side with respect to a partition wall in a heat exchanger, cooling water flows on the other side with respect to the partition wall, and the heating medium and cooling water flow in the same direction. A heat exchanger of a convection type is advantageous in terms of size reduction, because of its high heat exchanger effectiveness. When an evaporator is used for cooling liquid, a plate-type heat exchanger sometimes serves as an evaporator.

Patent Document 1: JP2014-163593A

SUMMARY OF THE INVENTION

When a plate-type heat exchanger is used as a condenser, a pressure of a heating medium flowing through the condenser is generally larger than a pressure of cooling water. Thus, the heating medium is likely to break into the partition wall from a corroded point or the like so as to be mixed with the cooling water, for example. If the heating medium breaks into the partition wall, the heating medium mixed with the cooling water flows out as water to be discharged, which results in undesired destruction of environment. In addition, since the heating medium decreases in the refrigeration apparatus, a compressor is likely to be seized. Thus, when the partition wall is broken, it is necessary to stop the heating medium from flowing outside as soon as possible.

The present invention has been made in view of the above circumstances. The object of the present invention is to provide a refrigeration apparatus capable of quickly detecting leakage of a heating medium from a condenser or an evaporator, by means of a simple structure.

The present invention is a refrigeration apparatus in which a compressor, a condenser, an expansion valve and an evaporator are connected by a pipe such that a heating medium circulates therethrough in this order, the refrigeration apparatus comprising: a pressure detection unit that detects a pressure of the heating medium flowing through the pipe; and a control unit that determines that leakage of the heating medium from the condenser or the evaporator has occurred, when a pressure detected by the pressure detection unit becomes not more than a predetermined value.

According to the refrigeration apparatus of the present invention, pressure reduction caused by leakage of the heating medium from the condenser or the evaporator can be detected by the control unit based on a detection result of the pressure detection unit provided on the refrigeration apparatus, whereby occurrence of leakage of the heating medium from the condenser or the evaporator can be determined without any complicated computing operation. Thus, leakage of the heating medium from the condenser or the evaporator can be quickly detected by a simple structure.

In the refrigeration apparatus according to the present invention, the condenser may be a plate-type heat exchanger in which a plurality of plate members are located to be spaced apart from each other, such that a channel for heating medium and a channel for cooing water, which are formed between the plate members that are adjacent to each other with their principal surfaces (main surfaces) being opposed, are alternately arranged, and each plate member may be formed by stacking two plates.

In this case, even when one of the two plates in the plate member is broken, there is no possibility that the heating medium and the cooling water mix with each other, leakage of the heating medium or the cooling water can be effectively prevented.

In the refrigeration apparatus according to the present invention, the pressure detection unit may detect a pressure of the heating medium flowing through a portion of the pipe, which portion is between the condenser and the expansion valve.

In the refrigeration apparatus according to the present invention, the pressure detection unit may detect a pressure of the heating medium flowing through a portion of the pipe, which portion is between the evaporator and the compressor.

In the refrigeration apparatus according to the present invention, when a pressure detected by the pressure detection unit becomes not more than a predetermined value for preliminary determination, the control unit may determine that the heating medium leaks in the condenser from the plate of the plate member, the plate being positioned on the channel for heating medium, to a space between the two plates, and when a pressure detected by the pressure detection unit becomes not more than a predetermined value for main determination that is smaller than the predetermined value for preliminary determination, the control unit may determine that the heating medium leaks in the condenser from the channel for heating medium to the channel for cooling water through the plate member.

In this case, at the stage of the predetermined value for preliminary determination, leakage of the heating medium can be detected, whereby it can be prevented that a large amount of the heating medium leaks thereafter.

In the refrigeration apparatus according to the present invention, the pressure detection unit may include a high-pressure-side pressure detection unit that detects a pressure of the heating medium flowing through a portion of the pipe, which portion is between the condenser and the expansion valve, and a low-pressure-side pressure detection unit that detects a pressure of the heating medium flowing through a portion of the pipe, which portion is between the evaporator and the compressor, and when a pressure detected by the high-pressure-side pressure detection unit becomes not more than a first predetermined value and when a pressure detected by the low-pressure-side pressure detection unit becomes not more than a second predetermined value, the control unit may determine that leakage of the heating medium from the condenser or the evaporator has occurred.

In the refrigeration apparatus according to the present invention, the pressure detection unit may include a first high-pressure-side pressure detection unit that detects a pressure of the heating medium flowing through a portion of the pipe, which portion is between the compressor and the condenser, and a second high-pressure-side pressure detection unit that detects a pressure of the heating medium flowing through a portion of the pipe, which portion is between the condenser and the expansion valve, and when a difference between a pressure detected by the first high-pressure-side pressure detection unit and a pressure detected by the second high-pressure-side pressure detection unit becomes not less than a third predetermined value, the control unit may determine that leakage of the heating medium from the condenser has occurred.

In this case, when a difference between a pressure detected by the first high-pressure-side pressure detection unit and a pressure detected by the second high-pressure-side pressure detection unit is less than the third predetermined value, and when a pressure detected by the first high-pressure-side pressure detection unit and a pressure detected by the second high-pressure-side pressure detection unit are respectively not more than a fourth predetermined value, the control unit may determine that leakage of the heating medium from the evaporator has occurred.

In the refrigeration apparatus according to the present invention, the pressure detection unit may include a first low-pressure-side pressure detection unit that detects a pressure of the heating medium flowing through a portion of the pipe, which portion is between the expansion valve and the evaporator, and a second low-pressure-side pressure detection unit that detects a pressure of the heating medium flowing through a portion of the pipe, which portion is between the evaporator and the compressor, and when a difference between a pressure detected by the first low-pressure-side pressure detection unit and a pressure detected by the second low-pressure-side pressure detection unit becomes not less than a fifth predetermined value, the control unit may determine that leakage of the heating medium from the evaporator has occurred.

In this case, when a difference between a pressure detected by the first low-pressure-side pressure detection unit and a pressure detected by the second low-pressure-side pressure detection unit is less than the fifth predetermined value, and when a pressure detected by the first low-pressure-side pressure detection unit and a pressure detected by the second low-pressure-side pressure detection unit are respectively not more than a sixth predetermined value, the control unit may determine that leakage of the heating medium from the condenser has occurred.

According to the above structure, since leakage of the heating medium from the condenser and leakage of the heating medium from the evaporator can be separately determined without increasing the number of the pressure detection units, a malfunctioning part can be efficiently identified and a succeeding repair operation can be smoothly carried out.

In the refrigeration apparatus according to the present invention, when the control unit determines that leakage of the heating medium has occurred, the control unit may stop circulation of the heating medium in the refrigeration apparatus, or may issue a warning.

According to this structure, progress of leakage of the heating medium can be restrained.

According to the present invention, leakage of a heating medium from a condenser or an evaporator can be quickly detected by a simple structure.

DETAILED DESCRIPTION OF THE INVENTION

Respective embodiments of the present invention will be described in detail below with reference to the attached drawings.

First Embodiment

Figure 1:
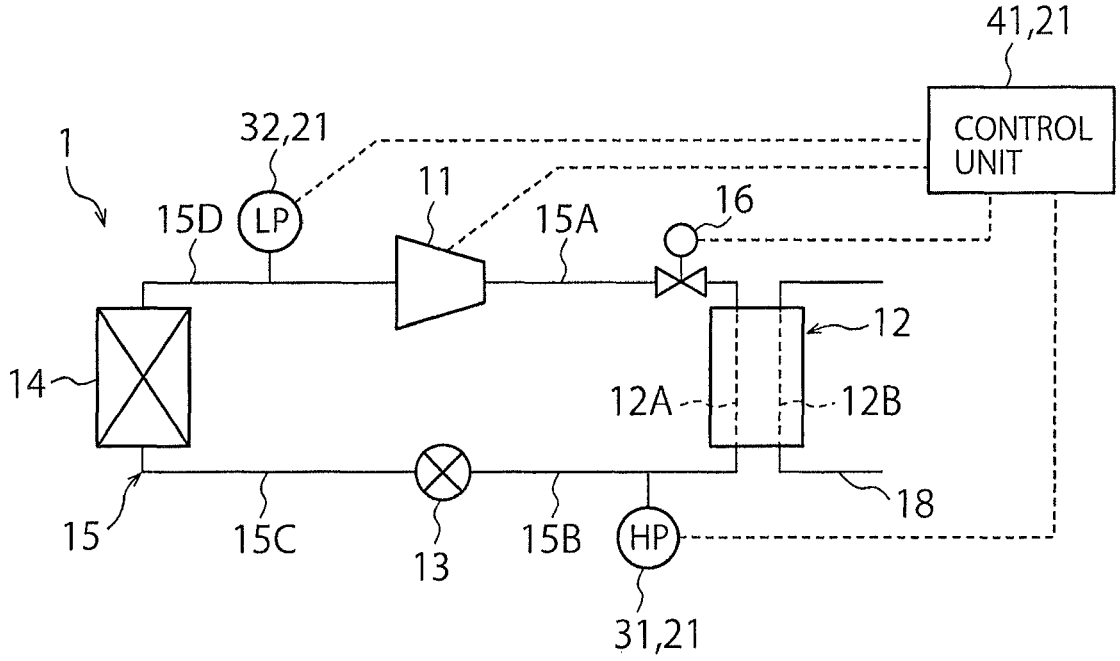
FIG. 1 is a circuit diagram of a refrigeration apparatus according to a first embodiment of the present invention.

FIG. 1 shows a circuit diagram of a refrigeration apparatus 1 according to a first embodiment. In the refrigeration apparatus 1, a compressor 11, a condenser 12, an expansion valve 13 and an evaporator 14 are connected by a pipe 15 such that a heating medium circulates therethrough in this order. The pipe 15 has a first portion 15A which connects the compressor 11 and the condenser 12, a second portion 15B which connects the condenser 12 and the expansion valve 13, a third portion 15C which connects the expansion valve 13 and the evaporator 14, and a forth portion 15D which connects the evaporator 14 and the compressor 11. In addition, the refrigeration apparatus 1 according to this embodiment further comprises a malfunction detection device 21 for detecting leakage of the heating medium. The malfunction detection device 21 has pressure detection units 31, 32 and a control unit 41.

The compressor 11 is configured to compress a gaseous heating medium having a low temperature and a low pressure, which has flown out from the evaporator 14, into a gaseous heating medium having a high temperature (e.g., 80° C.) and a high pressure, and to supply the heating medium to the condenser 12. The condenser 12 is configured to cool and condense the heating medium, which has been compressed by the compressor 11, by cooling water into a liquiform heating medium having a predetermined cooled temperature (e.g., 40° C.) and a high pressure, and to supply the heating medium to the expansion valve 13. Water may be used as the cooling water of the condenser 12. Another refrigerant medium may also be used.

The condenser 12 in this embodiment is formed of a plate-type heat exchanger, and has a first channel 12A through which a heating medium flows, and a second channel 12B through which cooling water flows. The first portion 15A of the pipe 15 is connected to an upstream end of the first channel 12A, and the second portion 15B of the pipe 15 is connected to a downstream end of the first channel 12A. In addition, a cooling water pipe 18 is connected to the second channel 12B, so that the condenser 12 is supplied with cooing water from the cooling water pipe 18. In such a condenser 12, heat is exchanged between the heating medium and the cooling water, so that the heating medium is cooled and condensed by the cooling water.

Figure 4:
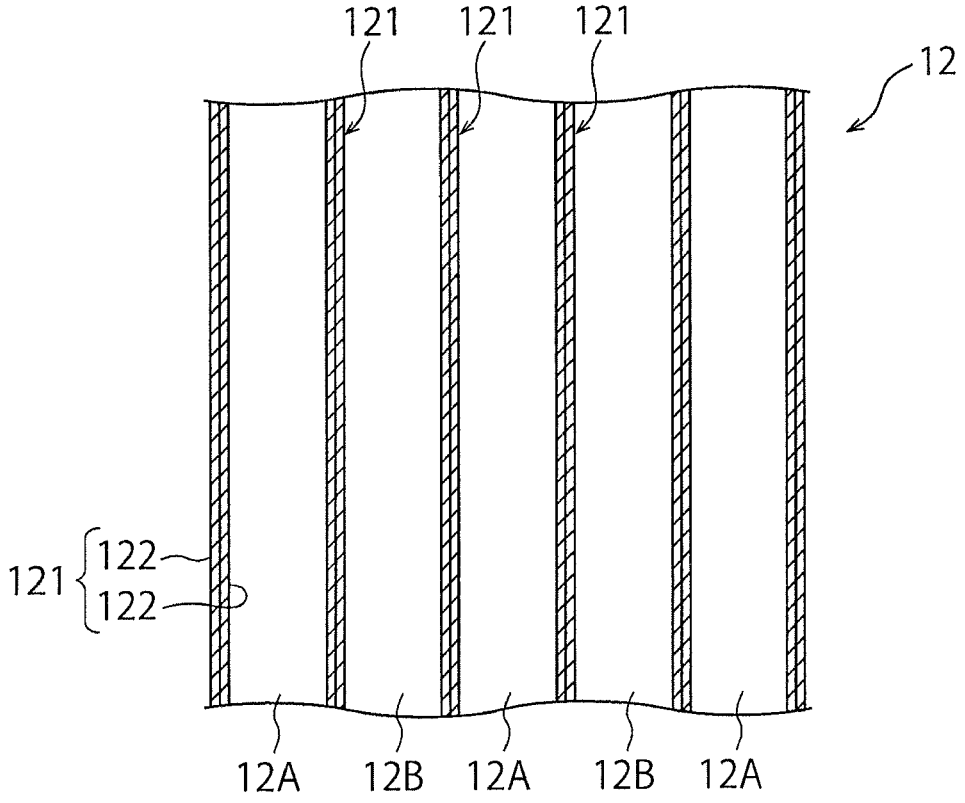
FIG. 4 is a sectional view of a condenser in a refrigeration apparatus, which is formed as a plate-type heat exchanger.

FIG. 4 shows a section view of the condenser 12 which is formed as a plate-type heat exchanger. As shown in FIG. 4, the condenser 12 is a plate-type heat exchanger in which a plurality of plate members 121 are positioned to be spaced apart from each other, such that the first channels 12A for heating medium and the second channels 12B for cooing water, which are formed between the plate members 121 that are adjacent to each other with their principal surfaces being opposed, are alternately arranged. In this embodiment, each plate member 121 is formed by stacking two plates 122, 122. In more detail, the two plates 122, 122 are joined to each other, e.g., by brazing at their outer peripheries. On the other hand, in a heat exchange area inside the outer peripheries, the plates 122, 122 are not joined. Thus, a small air layer is formed between the two plates 122, 122.

Returning to FIG. 1, the expansion valve 13 is configured to expand the heating medium, which has been supplied from the condenser 12, to reduce its pressure, into a liquid heating medium having a low pressure (e.g., 2° C.) and a low pressure, and to supply the heating medium to the evaporator 14. In this embodiment, the evaporator 14 is configured to exchange heat of the supplied heating medium and heat of air whose temperature is to be controlled, so as to cool the air. The heating medium having heat-exchanged with the air becomes a gaseous heating medium having a low temperature and a low pressure, and flows out from the evaporator 14. The heating medium is again compressed in the compressor 11. The evaporator 14 may be configured to cool a liquid by a heating medium. In this case, the evaporator 14 may be formed as a plate-type heat exchanger.

In addition, in this embodiment, the malfunction detection device 21 has the high-pressure-side pressure detection unit 31 that detects a pressure of the heating medium flowing through a portion (second portion 15B) of the pipe 15 between the condenser 12 and the expansion valve 13, and a low-pressure-side pressure detection unit 32 that detects a pressure of the heating medium flowing through a portion (fourth portion 15D) of the pipe 15 between the evaporator 14 and the compressor 11. The pressure detection units 31, 32 are electrically connected to the control unit 41. In this embodiment, the pressure detection units 31, 32 and the control unit 41 constitute the malfunction detection device 21. In this embodiment, the present detection unit 31, 32 converts a detected pressure into a voltage signal, and outputs the voltage signal to the control unit 41. The control unit 41 is configured to determine whether leakage of a heating medium from the condenser 12 or the evaporator 14 has occurred or not, based on the pressure detected by the pressure detection unit 31, 32. The control unit 41 may be a computer including a CPU, for example.

In more detail, when a pressure detected by the high-pressure-side pressure detection unit 31 becomes not more than a first predetermined value, or when a pressure detected by the low-pressure-side pressure detection unit 32 becomes not more than a second predetermined value, the control unit 41 in this embodiment determines that leakage of the heating medium from the condenser 12 or the evaporator 14 has occurred. In addition, when the control unit 41 determines that leakage of the heating medium has occurred, the control unit 41 is configured to stop circulation of the heating medium in the refrigeration apparatus 1, and to issue a warning.

In FIG. 1, the reference numeral 16 depicts a shut-off valve 16 disposed on the first portion 15A of the pipe 15. Specifically in this embodiment, when a pressure detected by the high-pressure-side pressure detection unit 31 becomes not more than the first predetermined value, or when a pressure detected by the low-pressure-side pressure detection unit 32 becomes not more than the second predetermined value, the control unit 41 isolates the shut-off valve 16 so as to stop the circulation of the heating medium. Simultaneously therewith, the control unit 41 outputs (issues) a warning sound, and stops the compressor 11. The control unit 41 may display (issue) a warning in a display device. Herein, the aforementioned first predetermined value is a pressure value that is smaller than a pressure of the heating medium that is compressed by the compressor 11 in a normal operation state without any leakage of the heating medium. In addition, the aforementioned second predetermined value is a pressure value that is smaller than a pressure of the heating medium that was expanded by the expansion valve 13 and then goes out from the evaporator 14 in the normal operation state. These first and second predetermined values are set as values based on which it can be deemed that leakage of the heating medium from the condenser 12 or the evaporator 14 highly probably has occurred. Since appropriate values vary depending on a kind of the heating medium and so on, the control unit 41 can optionally vary the predetermined values.

The inventor has found from the extensive studies that, when leakage of the heating medium from the condenser 12 or the evaporator 14 has occurred, a pressure detected by the low-pressure-side detection unit 32, in particular, a pressure downstream of the evaporator 14 detected by the same is more likely to vary under the influence of the leakage, as compared with a pressure detected by the high-pressure-side detection unit 31. Thus, when a pressure detected by the high-pressure-side detection unit 31 becomes not more than the first predetermined value, the control unit 41 may determine that leakage may possibly occur, and when a pressure detected by the low-pressure-side detection unit 32 becomes not more than the first predetermined value, the control unit 41 may determine that leakage has occurred.

According to the aforementioned refrigeration apparatus 1, pressure reduction caused by leakage of the heating medium from the condenser 12 or the evaporator 14 can be detected by the control unit 41 based on a detection result of the pressure detection unit 31, 32 provided on the refrigeration apparatus 1, whereby occurrence of leakage of the heating medium from the condenser 12 or the evaporator 14 can be determined without any complicated computing operation. Thus, leakage of the heating medium from the condenser 12 or the evaporator 14 can be quickly detected by a simple structure.

In addition, in this embodiment, the condenser 12 is a plate-type heat exchanger in which a plurality of plate members 121 are positioned to be spaced apart from each other, such that the first channels 12A for heating medium and the second channels 12B for cooing water, which are formed between the plate members 121 that are adjacent to each other with their principal surfaces being opposed, are alternately arranged, and each plate member 121 is formed by stacking two plates 122, 122. Thus, even when one of the two plates in the plate member 121 is broken, there is no possibility that the heating medium and the cooling water mix with each other, leakage of the heating medium or the cooling water can be effectively prevented.

In this embodiment, when a pressure detected by the high-pressure-side pressure detection unit 31 becomes not more than the first predetermined value, or when a pressure detected by the low-pressure-side pressure detection unit 32 becomes not more than the first predetermined value, it is determined that leakage of the heating medium has occurred. However, in place thereof, when a pressure detected by the high-pressure-side pressure detection unit 31 becomes not more than the first predetermined value, and when a pressure detected by the low-pressure-side pressure detection unit 32 becomes not more than the first predetermined value, it may be determined that leakage of the heating medium has occurred.

Herebelow, a modification example of the first embodiment is described. In this modification example, the structure of the control unit 41 differs from that of the first embodiment.

Namely, when a pressure detected by the low-pressure-side pressure detection unit 32 becomes not more than a predetermined value for preliminary determination, the control unit 41 according to this modification example is configured to determine that the heating medium leaks from the plate 122 of the plate member 121, the plate 122 being positioned on the side of the first channel 12A, to a space between the two plates 122, 122. On the other hand, when a pressure detected by the low-pressure-side pressure detection unit 32 becomes not more than a predetermined value for main determination that is smaller than the predetermined value for preliminary determination, the control unit 41 is configured to determine that the heating medium leaks from the first channel 12A to the second channel 12B through the plate member 121.

In such an example, the control unit 41 may perform different operations, depending on a case in which it is determined that the heating medium leaks in the condenser 12 from the plate 122 of the plate member 121, the plate 122 being positioned on the first channel 12A, to a space between the two plates 122, 122, and a case in which it is determined that the heating medium leaks in the condenser 12 from the first channel 12A to the second channel 12B through the plate member 121. For example, in the former case, the control unit 41 may issue a warning. In the latter case, the control unit 41 may issue a warning and may stop the circulation of the heating medium. In addition, in both the former and the latter cases, the control unit 41 may stop the circulation of the heating medium.

According to the above structure, at the stage of the predetermined value for preliminary determination, leakage of the heating medium can be detected, whereby it can be prevented that a large amount of the heating medium leaks thereafter. The structure according to the modification example may be applied to the high-pressure-side pressure detection unit 31.

Second Embodiment

Next, a second embodiment of the present invention is described. The same constituent elements in this embodiment as the constituent elements in the first embodiment have the same reference numerals, and their description is omitted. In this embodiment, the structure of the pressure detection unit differs from that of the first embodiment.

Figure 2:
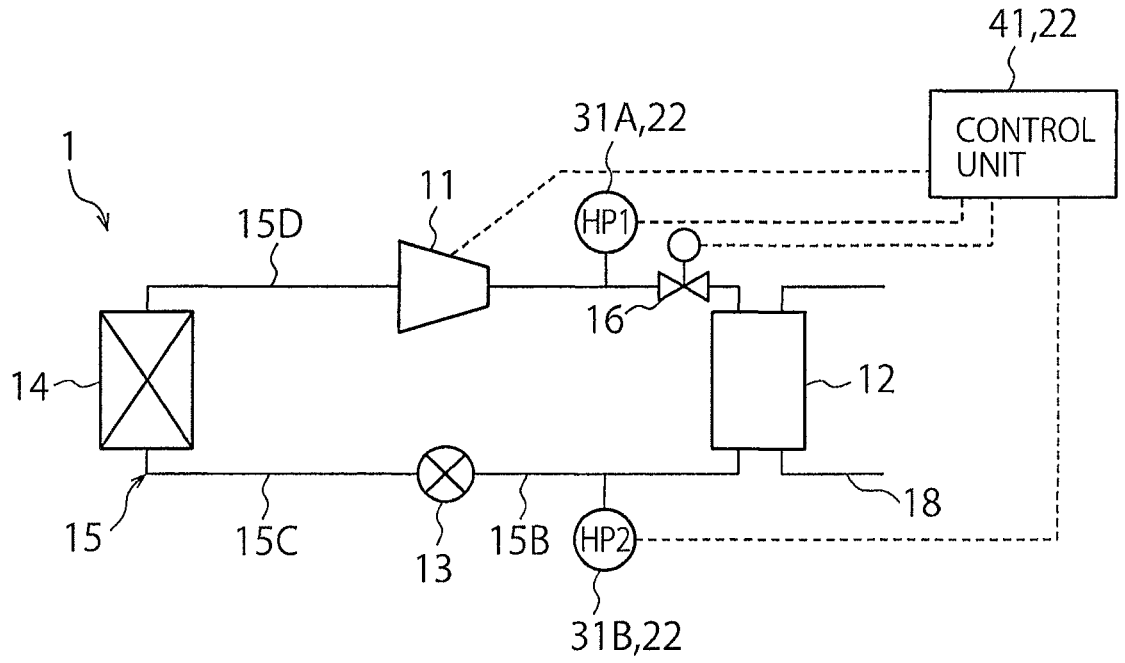
FIG. 2 is a circuit diagram of a refrigeration apparatus according to a second embodiment of the present invention.

As shown in FIG. 2, a malfunction detection device 22 according to this embodiment is composed of a first high-pressure-side pressure detection unit 31A which detects a pressure of a heating medium flowing through a portion (first portion 15A) of a pipe 15 between a compressor 11 and a condenser 12, a second high-pressure-side pressure detection unit 31B which detects a pressure of the heating medium flowing through a portion (second portion 15B) of the pipe 15 between the condenser 12 and an expansion valve 13, and a control unit 41 electrically connected to the pressure detection units 31A, 31B.

When a difference between a pressure detected by the first high-pressure-side pressure detection unit 31A and a pressure detected by the second high-pressure-side pressure detection unit 31B becomes not less than a third predetermined value, the control unit 41 determines that leakage of the heating medium from the condenser 12 has occurred. When a difference between a pressure detected by the first high-pressure-side pressure detection unit 31A and a pressure detected by the second high-pressure-side pressure detection unit 31B is large, it can be deemed that the heating medium highly probably has leaked from the condenser 12. Thus, the third predetermined value is set as a value which can be deemed that leakage of the heating medium from the condenser 12 highly probably has occurred.

In addition, when a difference between a pressure detected by the first high-pressure-side pressure detection unit 31A and a pressure detected by the second high-pressure-side pressure detection unit 31B is less than the third predetermined value, and when a pressure detected by the first high-pressure-side pressure detection unit 31A and a pressure detected by the second high-pressure-side pressure detection unit 31B are respectively not more than a fourth predetermined value, the control unit 41 in this embodiment is configured to determine that leakage of the heating medium from the evaporator 14 has occurred.

In this embodiment, when a difference between a pressure detected by the first high-pressure-side pressure detection unit 31A and a pressure detected by the second high-pressure-side pressure detection unit 31B is less than the third predetermined value, it is not determined that leakage of the heating medium from the condenser 12 has occurred. However, also in this case, leakage of the heating medium from the evaporator 14 may possibly occur. If leakage of the heating medium from the evaporator 14 has occurred, a pressure detected by the first high-pressure-side pressure detection unit 31A and a pressure detected by the second high-pressure-side pressure detection unit 31B are smaller than a pressure of the heating medium in a normal operation state without any leakage of the heating medium.

Thus, in this embodiment, the fourth predetermined value is set as a value that is smaller than a pressure of the heating medium which is compressed by the compressor 11 in a normal operation state without any leakage of the heating medium, and can be deemed that leakage of the heating medium from the evaporator 14 highly probably has occurred. Thus, when a pressure detected by the first high-pressure-side pressure detection unit 31A and a pressure detected by the second high-pressure-side pressure detection unit 31B are respectively not more than the fourth predetermined value, it can be determined that leakage of the heating medium from the evaporator 14 has occurred.

Also according to such a second embodiment, leakage of the heating medium from the condenser 12 or the evaporator 14 can be quickly detected by a simple structure. In particular, since leakage of the heating medium from the condenser 12 and leakage of the heating medium from the evaporator 14 can be separately determined without increasing the number of the pressure detection units, a malfunctioning part can be efficiently identified and a succeeding repair operation can be smoothly carried out.

Third Embodiment

Next, a third embodiment of the present invention is described. The same constituent elements in this embodiment as the constituent elements in the first and second embodiments have the same reference numerals, and their description is omitted. In this embodiment, the structure of the pressure detection unit differs from those of the first and second embodiments.

Figure 3:
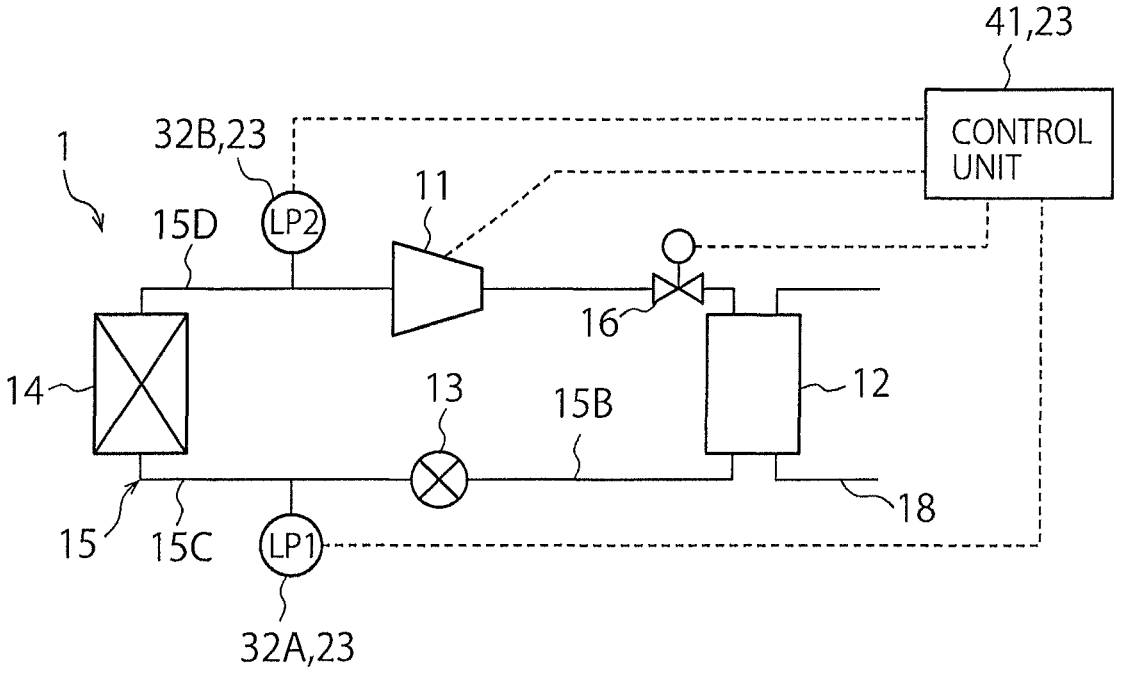
FIG. 3 is a circuit diagram of a refrigeration apparatus according to a third embodiment of the present invention.

As shown in FIG. 3, a malfunction detection device 23 according to this embodiment is composed of a first low-pressure-side pressure detection unit 32A which detects a pressure of a heating medium flowing through a portion (third portion 15C) of a pipe 15 between an expansion valve 13 and an evaporator 14, a second low-pressure-side pressure detection unit 32B which detects a pressure of the heating medium flowing through a portion (fourth portion 15D) of the pipe 15 between the evaporator 14 and a compressor 11, and a control unit 41 electrically connected to the pressure detection units 32A, 32B.

When a difference between a pressure detected by the first low-pressure-side pressure detection unit 32A and a pressure detected by the second low-pressure-side pressure detection unit 32B becomes not less than a fifth predetermined value, the control unit 41 determines that leakage of the heating medium from the evaporator 14 has occurred. When a difference between a pressure detected by the first low-pressure-side pressure detection unit 32A and a pressure detected by the second low-pressure-side pressure detection unit 32B is large, it can be deemed that a heating medium highly probably has leaked from the evaporator. Thus, the fifth predetermined value is set as a value which can be deemed that leakage of the heating medium from the evaporator 14 highly probably has occurred.

In addition, when a difference between a pressure detected by the first low-pressure-side pressure detection unit 32A and a pressure detected by the second low-pressure-side pressure detection unit 32B is less than the fifth predetermined value, and when a pressure detected by the first low-pressure-side pressure detection unit 32A and a pressure detected by the second low-pressure-side pressure detection unit 32B are respectively not more than a sixth predetermined value, the control unit 41 in this embodiment determines that leakage of the heating medium from the condenser 12 has occurred. According to such a third embodiment, the same effect as that of the second embodiment can be obtained.

1 . . . Refrigeration apparatus, 11 . . . Compressor, 12 . . . Condenser, 12A . . . First channel, 12B . . . Second channel, 121 . . . Plate member, 122 . . . Plate, 13 . . . Expansion valve, 14 . . . Evaporator, 15 . . . Pipe, 15A . . . First portion, 15B . . . Second portion, 15C . . . Third portion, 15D . . . Fourth portion, 16 . . . Shut-off valve, 21, 22, 23 . . . Malfunction detection device, 31 . . . High-pressure-side detection unit, 31A . . . First high-pressure-side detection unit, 31B . . . Second high-pressure-side detection unit, 32 . . . Low-pressure-side detection unit, 32A . . . First low-pressure-side detection unit, 32B . . . Second low-pressure-side detection unit, 41 . . . Control unit

What is claimed is:

1. A refrigeration apparatus comprising:

a compressor, a condenser, an expansion valve and an evaporator which are connected by a pipe such that a heating medium circulates therethrough, in this order;

a pressure detector that detects a pressure of the heating medium flowing through the pipe; and a control unit that determines that a leakage of the heating medium from the condenser has occurred based on a pressure detected by the pressure detector having a predetermined value, wherein the condenser is a heat exchanger having a plurality of plate members positioned spaced apart from each other to define a channel for the heating medium and a channel for cooling water between adjacent plate members whose principal surfaces are opposed, and wherein the channel for the heating medium and the channel for the cooling water are alternately arranged, wherein each plate member is defined by two stacked plates, and wherein, when the pressure detected by the pressure detector reaches a first predetermined value, the control unit determines that the heating medium in the condenser has leaked from one of the stacked plates defining one of the plate members that is positioned on the channel for the heating medium to a space between the two stacked plates, and when the pressure detected by the pressure detector reaches a second predetermined value that is smaller than the first predetermined value, the control unit determines that the heating medium in the condenser has leaked from the channel for the heating medium to the channel for the cooling water through one of the plate members.

2. A refrigeration apparatus comprising:

a compressor, a condenser, an expansion valve and an evaporator which are connected by a pipe such that a heating medium circulates therethrough, in this order;

a pressure detector that detects a pressure of the heating medium flowing through the pipe; and a control unit that determines that a leakage of the heating medium from the condenser or the evaporator has occurred based on a pressure detected by the pressure detector having a predetermined value, wherein the pressure detector includes a first high-pressure-side pressure detector that detects a pressure of the heating medium flowing through a portion of the pipe located between the compressor and the condenser, and a second high-pressure-side pressure detector that detects a pressure of the heating medium flowing through another portion of the pipe located between the condenser and the expansion valve, wherein, when a difference between the pressure detected by the first high-pressure-side pressure detector and the pressure detected by the second high-pressure-side pressure detector reaches a third predetermined value, the control unit determines that a leakage of the heating medium from the condenser has occurred, and wherein, when the difference between the pressure detected by the first high-pressure-side pressure detector and the pressure detected by the second high-pressure-side pressure detector is less than the third predetermined value, and when the pressure detected by the first high-pressure-side pressure detector and the pressure detected by the second high-pressure-side pressure detector respectively reach a fourth predetermined value, the control unit determines that a leakage of the heating medium from the evaporator has occurred.

3. A refrigeration apparatus comprising:

a compressor, a condenser, an expansion valve and an evaporator which are connected by a pipe such that a heating medium circulates therethrough, in this order;

a pressure detector that detects a pressure of the heating medium flowing through the pipe; and a control unit that determines that a leakage of the heating medium from the condenser or the evaporator has occurred based on a pressure detected by the pressure detection unit having a predetermined value, wherein the pressure detection unit includes a first low-pressure-side pressure detector that detects a pressure of the heating medium flowing through a portion of the pipe located between the expansion valve and the evaporator, and a second low-pressure-side pressure detector that detects a pressure of the heating medium flowing through another portion of the pipe located between the evaporator and the compressor, wherein, when a difference between the pressure detected by the first low-pressure-side pressure detector and the pressure detected by the second low-pressure-side pressure detector reaches a fifth predetermined value, the control unit determines that a leakage of the heating medium from the evaporator has occurred, and wherein, when the difference between the pressure detected by the first low-pressure-side pressure detector and the pressure detected by the second low-pressure-side pressure detector is less than the fifth predetermined value, and when the pressure detected by the first low-pressure-side pressure detector and a pressure detected by the second low-pressure-side pressure detector respectively reach a sixth predetermined value, the control unit determines that a leakage of the heating medium from the condenser has occurred.

* * * * *